US006749064B1

(12) United States Patent
Alrey

(10) Patent No.: US 6,749,064 B1
(45) Date of Patent: Jun. 15, 2004

(54) BAG WITH ARTICLE DISPLAY APERTURE AND SUPPORT SURFACE

(76) Inventor: Sanita L. Alrey, 9607 Meadowglen La., Houston, TX (US) 77063

( * ) Notice: Subject to any disclaimer, the term of this patent is extended or adjusted under 35 U.S.C. 154(b) by 0 days.

(21) Appl. No.: 09/939,219

(22) Filed: Aug. 26, 2001

Related U.S. Application Data

(60) Provisional application No. 60/228,269, filed on Aug. 25, 2000.

(51) Int. Cl.[7] ..... B65D 73/00; B65D 25/54

(52) U.S. Cl. ..... 206/457; 206/466; 206/736; 206/775; 206/769; 229/922; 229/168; 383/106; 383/111; 40/312

(58) Field of Search ..... 206/457, 461, 206/485, 775, 776, 466, 736, 774, 769; 229/922, 165, 162, 180, 18; 383/7, 10, 105, 106, 111; 40/312, 538, 539, 124.06, 308, 324

(56) References Cited

U.S. PATENT DOCUMENTS 2,278,359 A * 3/1942 Nagle ..... 229/17.24
2,939,620 A * 6/1960 Royce ..... 229/122.32
3,544,007 A * 12/1970 Bordman ..... 422/304
4,434,889 A * 3/1984 Fery ..... 206/216
4,991,980 A * 2/1991 Cohen et al. ..... 383/40
5,156,276 A 10/1992 Lebowitz
5,836,095 A 11/1998 Crowell
6,299,352 B1 * 10/2001 Julien ..... 383/40

* cited by examiner

*Primary Examiner*—J. Mohandesi
(74) *Attorney, Agent, or Firm*—Kenneth A Roddy

(57) ABSTRACT

A bag having an article display aperture and a folded support surface formed in a front panel thereof for supporting and displaying various types of articles. The bag is formed of relatively stiff material and its front panel is provided with cuts and scored areas defining a tab that is folded to form a generally wedge-shaped support surface for supporting various articles behind the aperture. The bag can be supported on a flat surface such as a counter top or a table top or may be suspended in an elevated position by handles at its upper end for displaying various articles, and may also be used as a conventional gift bag or shopping bag. An insert sheet formed of decorative material may also be inserted in the bag along its back panel to serve as a colorful background.

12 Claims, 4 Drawing Sheets

BAG WITH ARTICLE DISPLAY APERTURE AND SUPPORT SURFACE

CROSS REFERENCE TO RELATED APPLICATION

This application claims priority of U.S. Provisional Patent Application Serial No. 60/228,269 filed Aug. 25, 2000, the pendency of which is extended until Aug. 27, 2001 under 35 U.S.C. 119(e)(3).

BACKGROUND OF THE INVENTION

1. Field of the Invention

This invention relates generally to bags, and more particularly to a bag having an article display aperture and a folded support surface formed in a panel thereof for supporting and displaying various types of articles.

2. Brief Description of the Prior Art

Gift bags are a popular alternative for the traditional wrapped gift box for giving gifts. Typically, gift bags are brightly colored or decorated paper bags. Although the use of gift bags has become increasingly popular, the bags are formed in a general conventional manner having a front panel and a rear panel integrally connected with two side panels, with the side panels constructed for folding to enable the bag to be stored flat until its use is desired. In addition, handle members are also often incorporated on the front and rear panels for assisting in holding the bag along with its contents. In spite of the increased popularity and use of gift bags, most conventional gift bags are constructed similar to typical paper bags, but may be provided in various colors and surface ornamentation on the outer surface of the bag to provide a festive appearance.

Some bags and gift bags of the prior art employ overlays or may have cut out portions in one or more surfaces, but for the most part, not much has been done in an attempt to expand the functional purpose of the gift bag.

Crowell, U.S. Pat. No. 5,836,095 discloses a gift bag that functions as a display and article holding system utilizing a bag having one or more extendable portions, flaps or members on the surfaces of a bag which may depict various animals, characters, or objects. In one embodiment the bag is provided with a card-holding receptacle having handles mounted to opposed panels and a cut-out zone formed in one panel, preferably covered by transparent film, and an elongated slit formed in the panel above the cut-out zone to enable a user to attain access to the cut-out zone and transparent film whereby a conventional greeting or message bearing card can be inserted through the slit to be displayed through cut-out zone and transparent film.

Lebowitz, U.S. Pat. No. 5,156,276 discloses a box-like package for the point-of-purchase display of a product wherein the package has a combination of a container section, a pedestal section, and a retainer section. The container section comprises bottom and top walls with upstanding side walls. One of the side walls defines an opening which permits viewing of the product located within the container. The pedestal section overlies the bottom wall, and the product within the package is held in place by the pedestal section. The retainer section extends upwardly relative to the pedestal section, and provides a cutout portion for engagement with the product supported by the pedestal section. This retainer section holds the product against vertical shifting movement while the pedestal section is holding the product against lateral shifting movement.

The present invention is distinguished over the prior art in general, and these patents in particular by a bag having an article display aperture and a folded support surface formed in a front panel thereof for supporting and displaying various types of articles. The bag is formed of relatively stiff material and its front panel is provided with cuts and scored areas defining a tab that is folded to form a generally wedge-shaped support surface for supporting various articles behind the aperture. The bag can be supported on a flat surface such as a counter top or a table top or may be suspended in an elevated position by handles at its upper end for displaying various articles, and may also be used as a conventional gift bag or shopping bag. An insert sheet formed of decorative material may also be inserted in the bag along its back panel to serve as a colorful background.

SUMMARY OF THE INVENTION

It is therefore an object of the present invention to provide a bag that can be used as a novel means of attractively displaying various articles, and may also used as a conventional gift bag or shopping bag.

It is another object of this invention to provide a bag having an aperture in a front panel thereof for displaying various articles that can be supported on a flat surface such as a counter top or a table top, or may be suspended in an elevated position by its handles.

Another object of this invention is to provide a bag having an article display aperture in a front panel for displaying various articles and a decorative insert along a back panel that serves as a colorful background.

Another object of this invention is to provide a bag formed of relatively stiff material having an article display aperture in a front panel and an inwardly inclined generally wedge-shaped support surface adjoined to a bottom edge of the aperture.

A further object of this invention is to provide a bag having cut lines and scored areas defining a tab that can be easily and quickly folded to form a generally wedge-shaped support surface for supporting various articles behind an aperture in a front panel of the bag.

A still further object of this invention is to provide a bag formed of relatively stiff material having an article display aperture in a front panel and an inwardly inclined generally wedge-shaped support surface which is simple in construction, attractive in appearance and inexpensive to manufacture.

Other objects of the invention will become apparent from time to time throughout the specification as hereinafter related.

The above noted objects and other objects of the invention are accomplished by a bag having an article display aperture and a folded support surface formed in a front panel thereof for supporting and displaying various types of articles. The bag is formed of relatively stiff material and its front panel is provided with cuts and scored areas defining a tab that is folded to form a generally wedge-shaped support surface for supporting various articles behind the aperture. The bag can be supported on a flat surface such as a counter top or a table top or may be suspended in an elevated position by handles at its upper end for displaying various articles, and may also be used as a conventional gift bag or shopping bag. An insert sheet formed of decorative material may also be inserted in the bag along its back panel to serve as a colorful background.

DESCRIPTION OF THE PREFERRED EMBODIMENT

Figure 2:
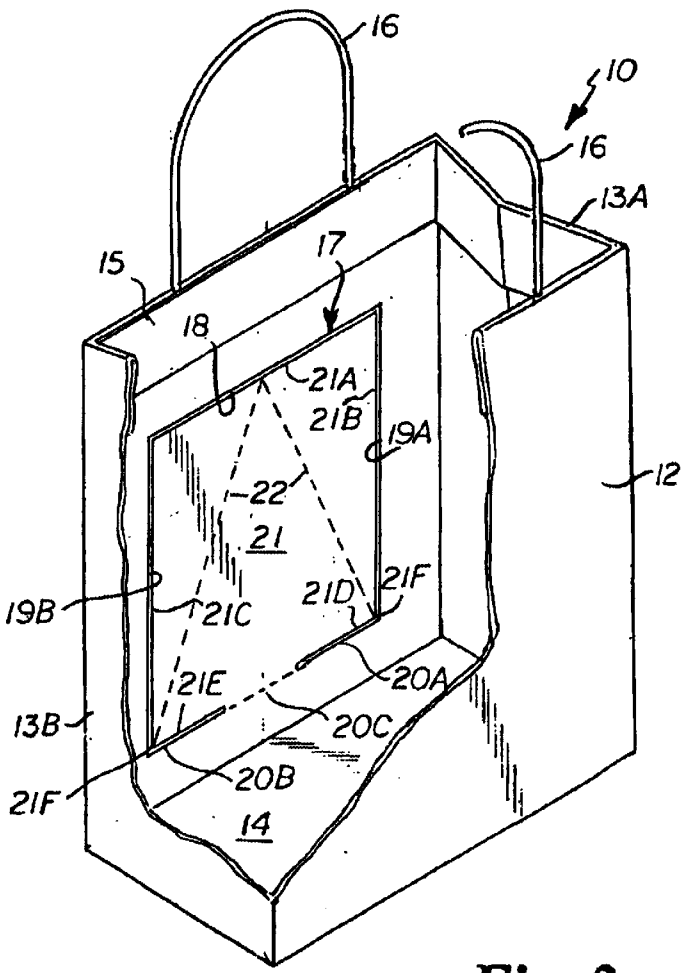
FIG. 2 is a partial perspective view showing the back side of the tab formed by the cuts on the front panel in an unfolded condition.

Referring to the drawings by numerals of reference there is shown in FIGS. 1 through 6, a bag 10 in accordance with the present invention. The bag 10 has a front panel 11, a back panel 12, a pair of side panels 13A, 13B and a bottom panel 14. The bag 10 has an open top end 15 and a pair of conventional twisted paper handles 16 secured to the upper ends of the front and back panels 11, 12. The front panel 11, side panels 13A, 13B, and back panel 12 are formed in a conventional manner well known in the art of shopping bag and gift bag construction and may be scored in the usual manner, as indicated by dashed lines F, to allow the bag to be folded into a generally flat configuration.

Figure 1:
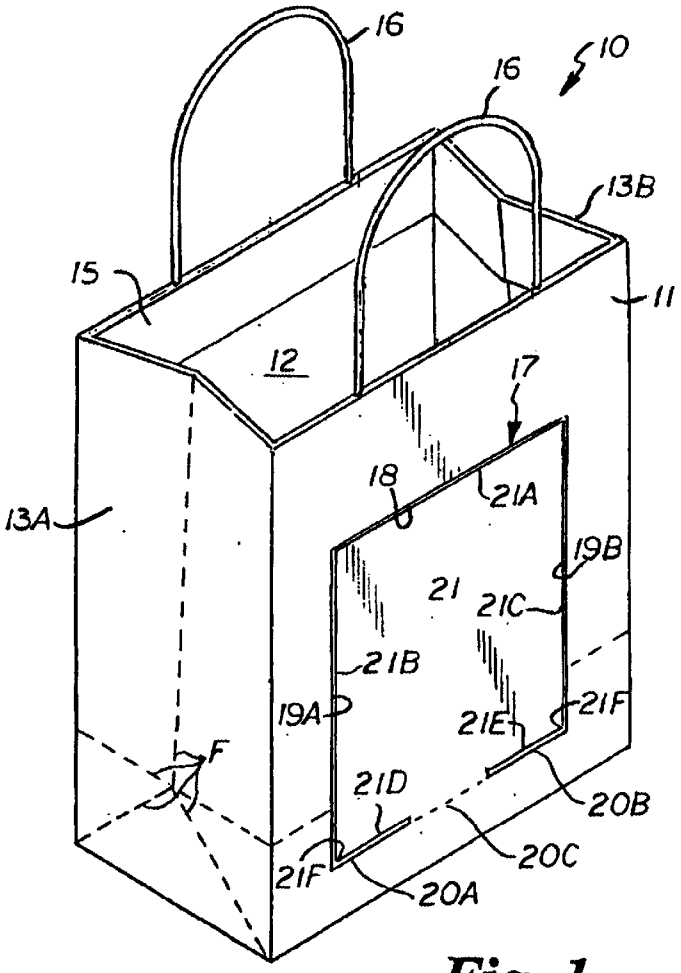
FIG. 1 is a perspective view of the bag in accordance with the present invention shown from the front in an unfolded condition.

The present bag 10 is constructed of stiff heavy-duty paper or cardboard material and, in a preferred embodiment, is formed of heavy-duty corrugated paper. As shown in FIG. 1, the front panel 11 is provided with a generally rectangular opening or aperture 17. The opening or aperture 17 is formed by straight cuts through the front panel 11 to create a top side 18 and opposed lateral sides 19A, 19B of the rectangular aperture. The bottom side of the aperture 17 is formed by straight cuts 20A, 20B through the front panel 11 that extend laterally inward in opposed relation from the bottom of the opposed lateral side cuts 19A, 19B and terminate approximately ⅓ of the distance from each side cut, leaving an uncut portion 20C spanning approximately ⅓ of the bottom side.

As best seen in FIGS. 1 and 2, the cuts described above define a flat generally rectangular tab 21 joined to the front panel 11 only by the uncut portion 20C at the bottom side of the aperture 17. The uncut portion 20C may be scored as indicated by dashed lines to facilitate folding, as described below. The tab 21 has a top edge 21A, lateral side edges 21B, 21C, and laterally opposed shorter bottom edges 21D, 21E. As shown from the back side in FIG. 2, the back side of the tab 21 is scored from the center of its top edge 21A to its bottom corners 21F, as indicated by dashed lines 22.

Figure 4:
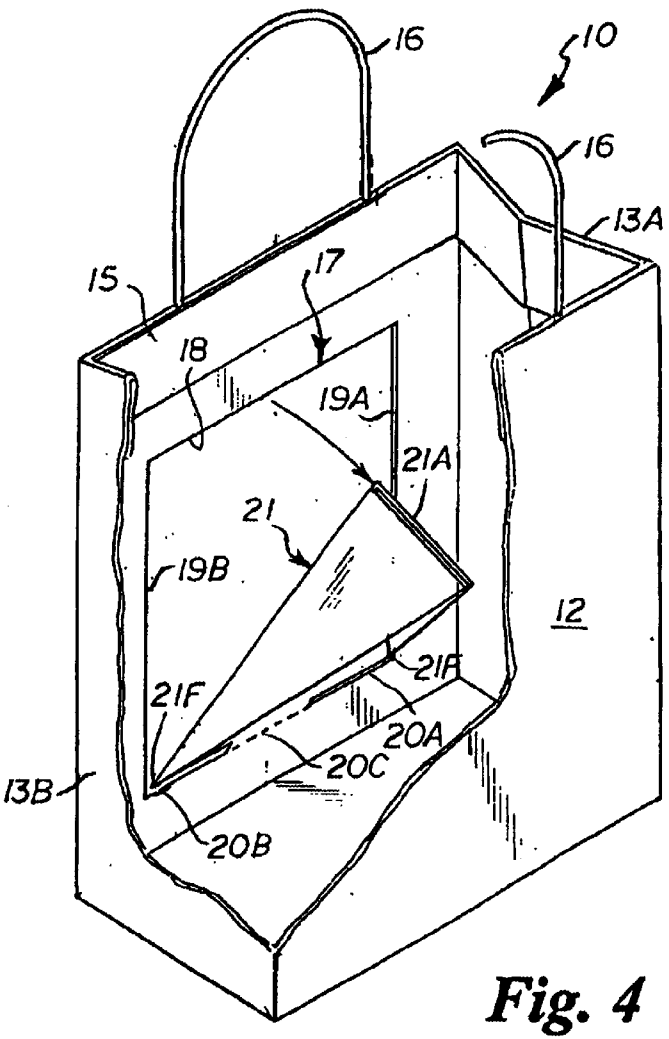
FIG. 4 is a perspective view showing the tab folded tab along its top edge and pushed inwardly to form an inclined generally wedge-shaped support surface.
Figure 3:
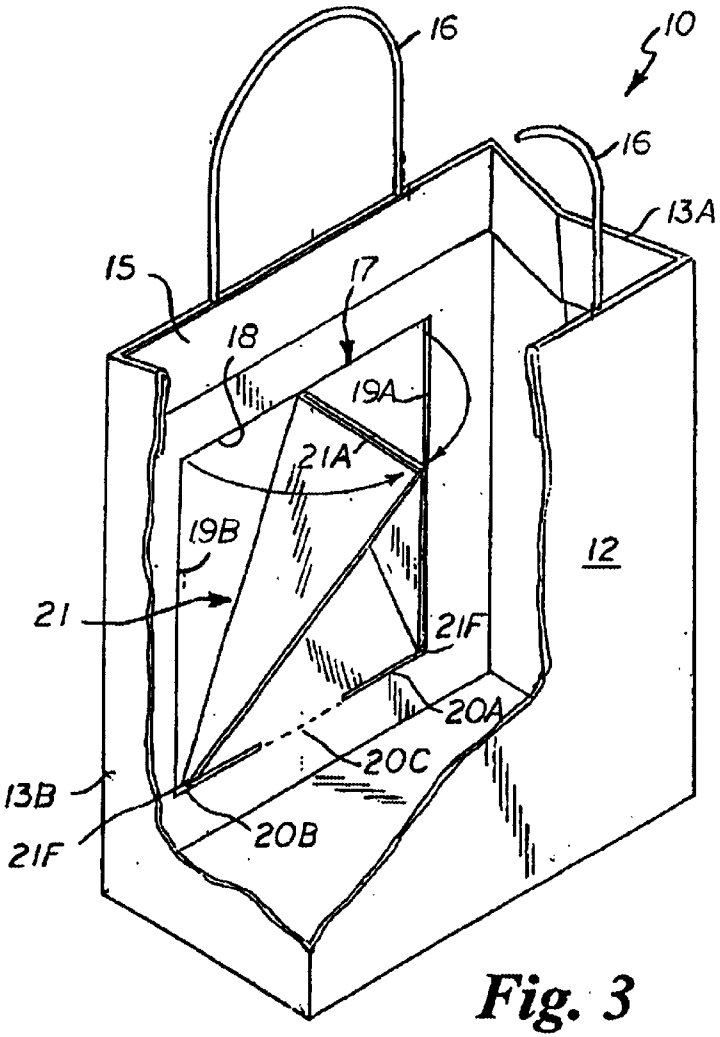
FIG. 3 is a partial perspective view showing the tab from the back side after its top edge has been folded in half.
Figure 5:
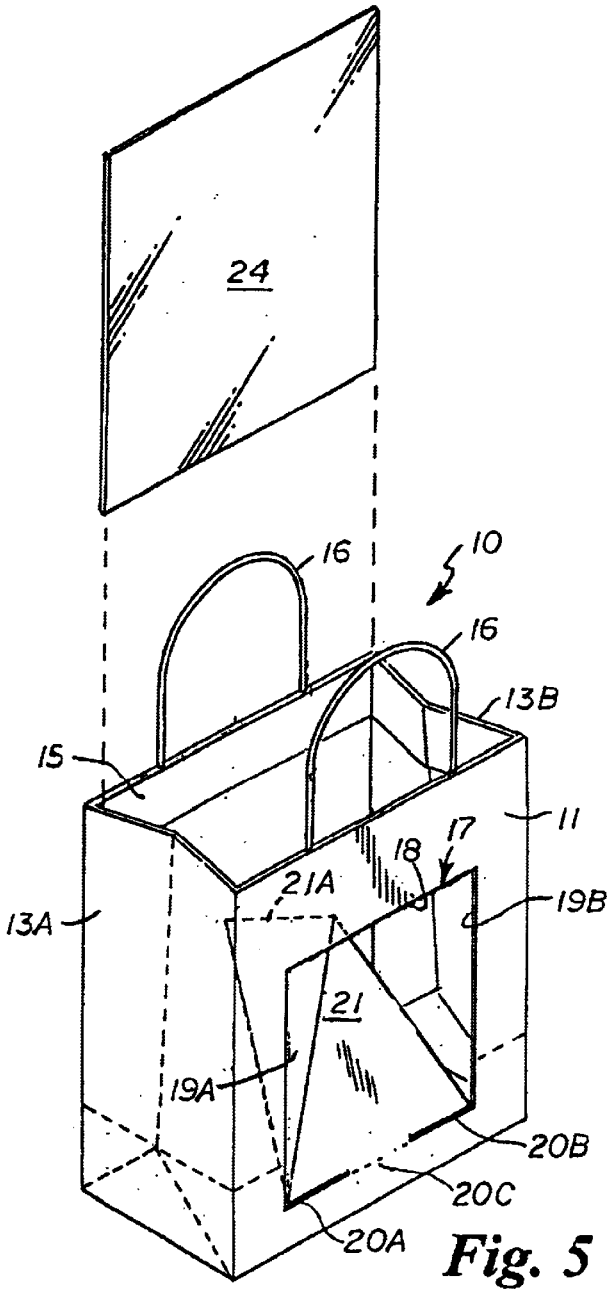
FIG. 5 is a perspective view of the bag as seen from the front, showing the inclined generally wedge-shaped support surface formed by the folded tab and showing a decorative sheet being inserted in the bag against the back panel.
Figure 6:
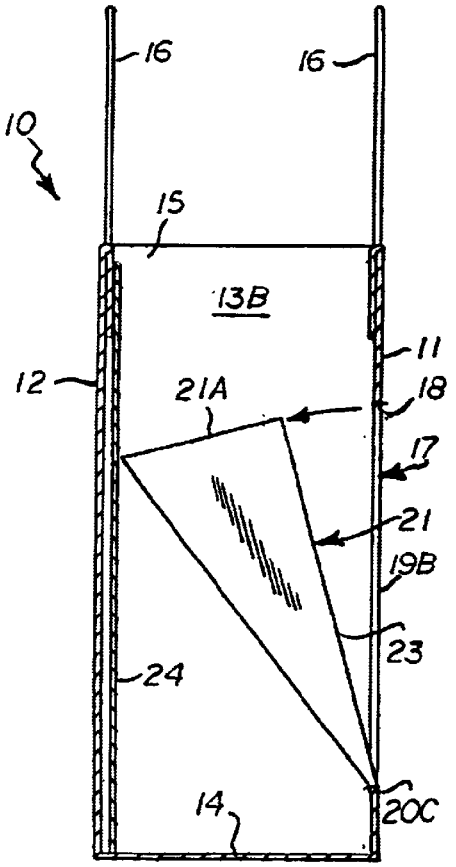
FIG. 6 is a side view in cross section, showing the inclined generally wedge-shaped support surface engaged against the decorative sheet and back panel.

Referring now to FIG. 3, the top edge 21A of the tab 22 is folded in half and along the score lines 22. The upper ends of the two halves of the top edge 21A are secured together by conventional means such as glue, staples or tape. This folding and securing operation forms the tab 21 into a generally wedge-shaped configuration joined to the front panel 11 only by the uncut portion 20C. As shown in FIGS. 4, 5 and 6, the generally wedge-shaped tab configuration is then folded inwardly toward the center of the bag along the uncut portion 20C, until the back end of the folded top edge 21A is engaged on the inner surface of the back panel 12 of the bag, or against a decorative sheet installed along the inner surface of the back panel (described below), thus forming an inclined flat generally wedge-shaped support surface 23.

As shown in FIG. 5, following the folding operation, the front panel 11 of the bag 10 has a generally rectangular aperture 17 with an inwardly inclined generally wedge-shaped support surface 23 adjoined to the bottom edge of the aperture by the uncut portion 20C and supported against the inner surface of the back panel of the bag. Also as seen in FIGS. 5 and 6, a rectangular sheet of colored foil or colorful holographic sheet of material 24 may be inserted into the bag 10 against the inner side of the back panel 12 to form a decorative background.

Figure 7:
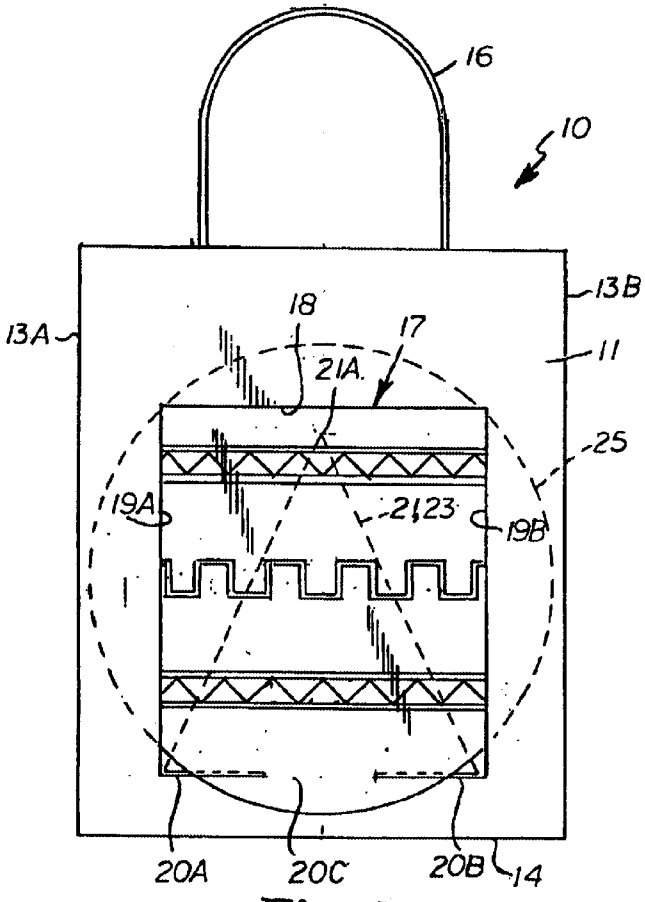
FIG. 7 is a front elevation view of the bag, showing a decorated dinnerware plate supported and displayed.

FIG. 7 shows a decorated dinnerware plate 25 supported in the bag 10 between the aperture 17 and the inclined generally wedge-shaped support surface 23. The laterally opposed sides of the plate 25 are engaged on the inside of the bag 10 and the lower portion of the plate is disposed outside of the bottom of the aperture 17 and the decorated front central portion of the plate that bears the artwork or pattern can be clearly seen through the aperture 17.

Figure 8:
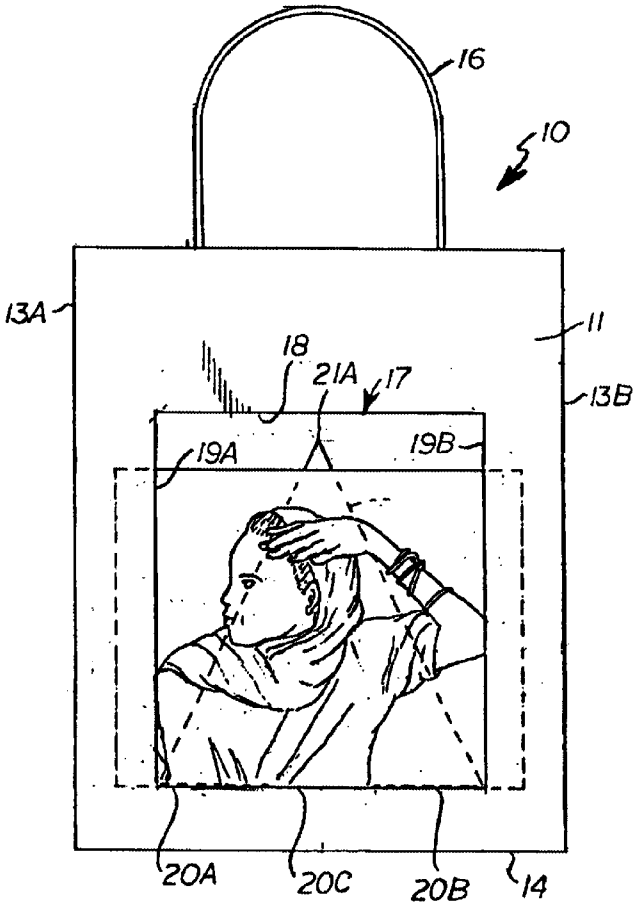
FIG. 8 is a front elevation view of the bag showing a photograph supported and displayed.

FIG. 8 shows a photograph 26 supported in the bag 10 between the aperture 17 and the inclined generally wedge-shaped support surface 23. The laterally opposed sides of the photograph 26 are engaged on the inside of the bag 10 and the central portion of the photograph can be clearly seen through the aperture 17.

The bag 10 can be supported on a flat surface such as a counter top or table top or may be suspended in an elevated position by its handles 16 to display various articles. and may also be used as a conventional gift bag or shopping bag.

While this invention has been described fully and completely with special emphasis upon preferred embodiments, it should be understood that within the scope of the appended claims the invention may be practiced otherwise than as specifically described herein.

What is claimed is:

1. A bag for use in containing and for displaying an article, comprising:

a bag of unitary construction having a front panel, a back panel, a bottom panel, laterally opposed side panels, and an open top end defining an interior compartment for receiving and containing an article to be displayed;

an opening in said front panel for permitting display and viewing of an article within said interior compartment; and an inclined generally flat support surface adjoined to a bottom edge of said opening and extending inward and upwardly therefrom within said interior compartment and having an upper end supported against an inner facing surface of said back panel for supporting the article to be displayed within said interior compartment in a position closely adjacent to said opening.

2. The bag according to claim 1, wherein said support means comprises a portion of said front panel cut to form a tab portion having an inclined generally flat support surface adjoined to a bottom edge of said opening and extending inward and upward therefrom and having an upper end supported against an inner facing surface of said back panel.

3. The bag according to claim 2, wherein said support means comprises a generally rectangular tab portion cut out of said front panel hinged at a bottom edge to a bottom edge of said opening and folded along lateral sides and a top edge to form an inclined generally wedge-shaped flat support surface; and said opening in said front panel is a generally rectangular opening created when said generally rectangular tab portion is cut out of said front panel.

4. The bag according to claim 1, further comprising:

a pair of handles each secured to an upper end of said front and back panel, respectively.

5. The bag according to claim 4, wherein said pair of handles are formed of twisted paper.

6. The bag according to claim 1, further comprising:

means for forming a decorative background on an inner facing surface of said back panel.

7. The bag according to claim 6, wherein said means for forming a decorative background comprises a generally rectangular sheet of decorative material supported on an inner facing surface of said back panel.

8. The bag according to claim 1, wherein said bag is constructed of a generally stiff material selected from the group consisting of paper, cardboard, and corrugated paper.

9. The bag according to claim 1, wherein said side panels and at least one of said front panel or said back panel are scored to allow said bag to be folded into a generally flat configuration when not in use.

10. A bag for use in containing and for displaying an article, comprising:

a bag of unitary construction having a front panel, a back panel, a bottom panel, laterally opposed side panels, and an open top end defining an interior compartment for receiving and containing an article to be displayed;

an opening in said front panel for permitting display and viewing of an article within said interior compartment; and a tab portion adjoined to a bottom edge of said opening adapted to be folded into a support surface extending inward and upward from said bottom edge with an upper end supported against an inner facing surface of said back panel for supporting the article to be displayed within said interior compartment in a position closely adjacent to said opening.

11. The bag according to claim 10, wherein said opening in said front panel is a generally rectangular opening; and said tab portion comprises a generally rectangular tab portion hinged at a bottom edge to a bottom edge of said opening and folded along lateral sides and a top edge to form an inclined generally wedge-shaped flat support surface.

12. The bag according to claim 10, further comprising:

a sheet of decorative material for installation adjacent to an inner facing surface of said back panel to form a decorative background.

* * * * *